US010393462B2

(12) United States Patent
Tertin et al.

(10) Patent No.: US 10,393,462 B2
(45) Date of Patent: Aug. 27, 2019

(54) FIREARM BARRELS WITH INTEGRATED SOUND SUPPRESSORS

(71) Applicant: Saeilo Enterprises, Inc., Greeley, PA (US)

(72) Inventors: James Tertin, Pillager, MN (US); Joseph Goerges, Pine River, MN (US); Nolan Michaelson, Breezy Point, MN (US)

( * ) Notice: Subject to any disclaimer, the term of this patent is extended or adjusted under 35 U.S.C. 154(b) by 0 days.

(21) Appl. No.: 15/493,071

(22) Filed: Apr. 20, 2017

(65) Prior Publication Data

US 2018/0306543 A1 Oct. 25, 2018

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/34; F41A 21/325; F41A 21/02; F41A 21/04
USPC ..... 89/14.4; 181/223; 42/90
See application file for complete search history.

(56) References Cited

U.S. PATENT DOCUMENTS 7,516,690 B2 * 4/2009 McClellan ..... F41A 21/30 181/223
8,196,701 B1 * 6/2012 Oliver ..... F41A 21/30 181/223
8,453,789 B1 * 6/2013 Honigmann ..... F41A 21/30 181/223
8,459,405 B1 * 6/2013 Dueck ..... F41A 21/30 181/223
8,459,406 B1 * 6/2013 Dueck ..... F41A 21/30 181/223
9,482,483 B2 * 11/2016 Whelan ..... F41A 21/30
9,506,712 B2 * 11/2016 Mather ..... F41A 21/482
9,739,559 B2 * 8/2017 Bush ..... F41A 21/30
9,835,400 B2 * 12/2017 Barrett ..... F41A 21/325
9,857,137 B2 * 1/2018 Barrett ..... F41A 21/28
D823,972 S * 7/2018 Barrett ..... D22/108
10,066,897 B2 * 9/2018 Hwang ..... F41A 21/484
10,113,826 B2 * 10/2018 Bray ..... F41A 21/30
10,119,779 B1 * 11/2018 Miele ..... F41A 21/30
2013/0180150 A1 * 7/2013 Dueck ..... F41A 21/325 42/90
2013/0180796 A1 * 7/2013 Dueck ..... F41A 21/30 181/223
2013/0180797 A1 * 7/2013 Dueck ..... F41A 21/30 181/223
2014/0231168 A1 * 8/2014 Dueck ..... F41A 21/325 181/223
2015/0040454 A1 * 2/2015 Naik ..... F41A 21/02 42/75.02

(Continued)

*Primary Examiner* — Michael D David
(74) *Attorney, Agent, or Firm* — Bennet K. Langlotz; Langlotz Patent & Trademark Works, LLC

(57) ABSTRACT

The present disclosure relates to a firearm barrel assembly comprising: a barrel; a sleeve disposed within and spaced apart from the barrel and forming a chamber between the inner surface of the barrel and the outer surface of the sleeve; and a sound suppression assembly disposed within the sleeve and comprising at least one vent aperture in communication with the chamber such that shear and expanding gases from a fired bullet are directed into the chamber.

15 Claims, 6 Drawing Sheets

(56) References Cited

U.S. PATENT DOCUMENTS

| | | | | |
|---|---|---|---|---|
| 2015/0241159 | A1* | 8/2015 | Michal | F41A 21/30 89/14.4 |
| 2015/0308772 | A1* | 10/2015 | James | F41A 21/30 89/14.4 |
| 2015/0354422 | A1* | 12/2015 | Liskey | F41A 21/30 89/14.4 |
| 2016/0003570 | A1* | 1/2016 | Tonkin | F41A 21/02 89/14.4 |
| 2016/0018179 | A1* | 1/2016 | Morris | F41A 21/30 181/223 |
| 2016/0209144 | A1* | 7/2016 | Tertin | B23P 11/025 |
| 2016/0209152 | A1* | 7/2016 | Dueck | B23K 26/282 |
| 2017/0205175 | A1* | 7/2017 | Garst | F41A 21/30 |

* cited by examiner

FIREARM BARRELS WITH INTEGRATED SOUND SUPPRESSORS

FIELD OF THE INVENTION

The present disclosure is directed to firearms with sound suppression systems and more particularly to firearms having a sound suppressor system integrated with the barrel.

BACKGROUND OF THE INVENTION

Traditionally, sound suppressors are attached to the end of a firearm, increasing the length of the barrel. Sound suppressors function to reduce the speed of expanding gases exiting the barrel after firing a bullet. Current sound suppressors assembly are added to the end of a barrel and therefore increase the overall length of the barrel, which is undesirable. Further, certain barrel designs, such as the barrel design in U.S. Publication No. 20160209144, which is incorporated herein by reference for all useful purposes, have a hollow barrel design. There is a need for a sound suppression assembly to incorporate the barrel into the sound suppression assembly to increase the effectiveness and decrease the overall length, particularly when utilizing a hollow barrel design.

SUMMARY OF THE INVENTION

In one aspect, the present disclosure is directed to a firearm barrel assembly comprising: an elongated barrel defining a bore having a bore axis; the barrel having a breech end adapted for connection to a firearm frame; the barrel having a muzzle end having a muzzle mounting facility; a sleeve defining a sleeve bore and having a rear end adapted for connection to the firearm frame, the sleeve having a forward end opposite the rear end; a suppressor tube element having a rear end having a rear mounting facility adapted to mate with the muzzle mounting facility of the barrel, the suppressor tube element having an open forward end and defining a tube chamber; a baffle element received in the tube chamber and having a width less than a width of the open forward end of the tube element; and the tube element having a forward end having a forward attachment facility adapted for contacting the forward end of the sleeve.

The tube element can be closely received within the sleeve.

The barrel can have an intermediate portion spaced apart from the sleeve to define an expansion chamber aft of the tube element.

The tube element can define a central aperture adapted to receive the barrel muzzle, and defines a vent aperture communicating between the tube chamber and the expansion chamber.

The barrel assembly can include a plurality of vent apertures surrounding the central aperture.

The barrel assembly can include a forward end cap defining a bullet aperture and adapted to be removably connected to the forward end of the tube element to restrain the tube element.

The barrel assembly can include a gasket element, disposed on the forward end of the baffle, and compressibly received between the forward end cap and a forward end of the baffle element and encircling the bullet aperture to limit gas flow between the forward end cap and the baffle element. Moreover, the gasket element can keep the end cap tight and allow for easy removal of the end cap without special tools.

The forward attachment facility can include a rearward facing shoulder adapted to abut the forward end of the sleeve.

The muzzle mounting facility and the rear mounting facility of the suppressor tube can be adapted to remain connected to each other under tension.

The barrel and suppressor tube can be under tension, and the sleeve can be in compression.

The muzzle mounting facility and the rear mounting facility of the suppressor tube can be threaded.

The present disclosure relates to a firearm barrel assembly comprising: an elongated barrel defining a bore having a bore axis; the barrel having a breech end adapted for connection to a firearm frame; the barrel having a muzzle having a muzzle mounting facility; a sleeve defining a sleeve bore and having a rear end adapted for connection to the firearm frame, the sleeve having a forward end; a suppressor tube element having a rear end having a rear mounting facility adapted to mate with the muzzle mounting facility of the barrel, the suppressor tube element having an open forward end and defining a tube chamber; a baffle element received in the tube chamber and having a width less than a width of the open forward end of the tube element, the tube element having an attachment facility adapted for contacting the forward end of the sleeve the rear end tube element defining a plurality of vent apertures providing gas communication to a chamber surrounding the barrel and encompassed by the sleeve.

The tube element can be closely received within the sleeve.

The barrel can have an intermediate portion spaced apart from the sleeve to define an expansion chamber aft of the tube element.

The tube element can define a central aperture adapted to receive the barrel muzzle, and the vent apertures surrounding the central aperture.

The barrel assembly can include a forward end cap defining a bullet aperture and adapted to be removably connected to the forward end of the tube element to restrain the tube element. No special tooling is needed to remove the connected components.

The barrel assembly can include a gasket element compressibly received between the forward end cap and a forward end of the baffle element and encircling the bullet aperture to limit gas flow between the forward end cap and the baffle element. Moreover, the gasket element can provide friction to the removable end cap.

The attachment facility includes a rearward facing shoulder adapted to abut the forward end of the sleeve.

The muzzle mounting facility and the rear mounting facility of the suppressor tube are adapted to remain connected to each other under tension.

The present disclosure relates to a firearm barrel assembly comprising: a barrel; a sleeve disposed within and spaced apart from the barrel and forming a chamber between the inner surface of the barrel and the outer surface of the sleeve; a sound suppression assembly disposed within the sleeve and comprising at least one vent aperture in communication with the chamber such that shear and expanding gases from a fired bullet are directed into the chamber.

BRIEF DESCRIPTION OF THE DRAWINGS

The disclosure can be best understood by those having ordinary skill in the art by reference to the following detailed description when considered in conjunction with the accompanying drawings in which.

DESCRIPTION OF THE CURRENT EMBODIMENT

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the claimed invention. It is to be understood that this invention is not limited to the specific devices, methods, conditions or parameters described herein, and that the terminology used herein is for the purpose of describing particular embodiments by way of example only and is not intended to be limiting of the claimed invention. Also, as used in the specification containing the appended claims, the singular forms "a," "an," and "the" include the plural, and reference to a numerical value includes at least that particular value, unless the context clearly dictates otherwise. Ranges may be expressed herein as from "about" or "approximately" one value and/or to "about" or "approximately" another particular value.

Figure 1:
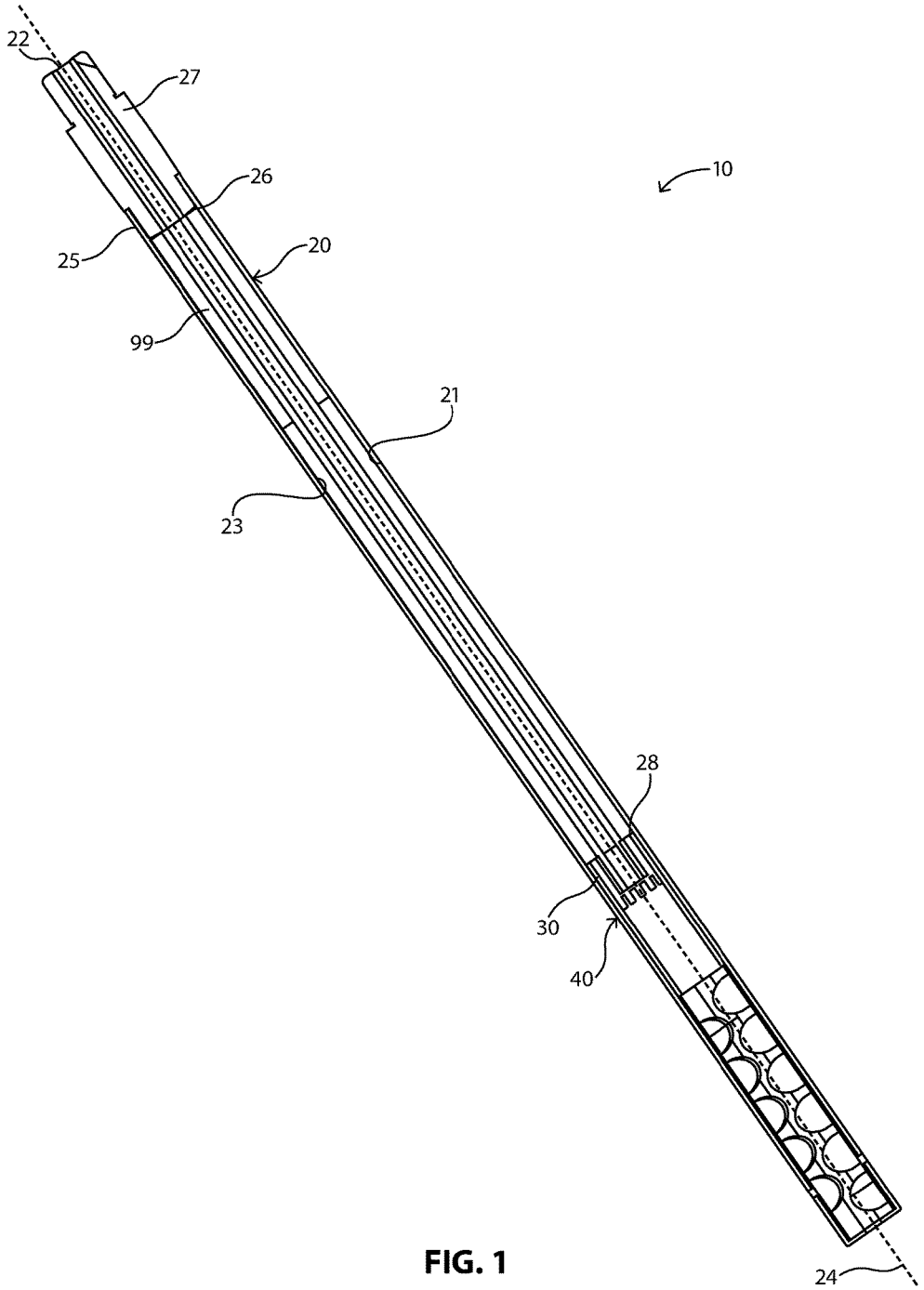
FIG. 1 illustrates a side cross section of a complete barrel assembly with an integrated sound suppression assembly according to one embodiment.
Figure 2:
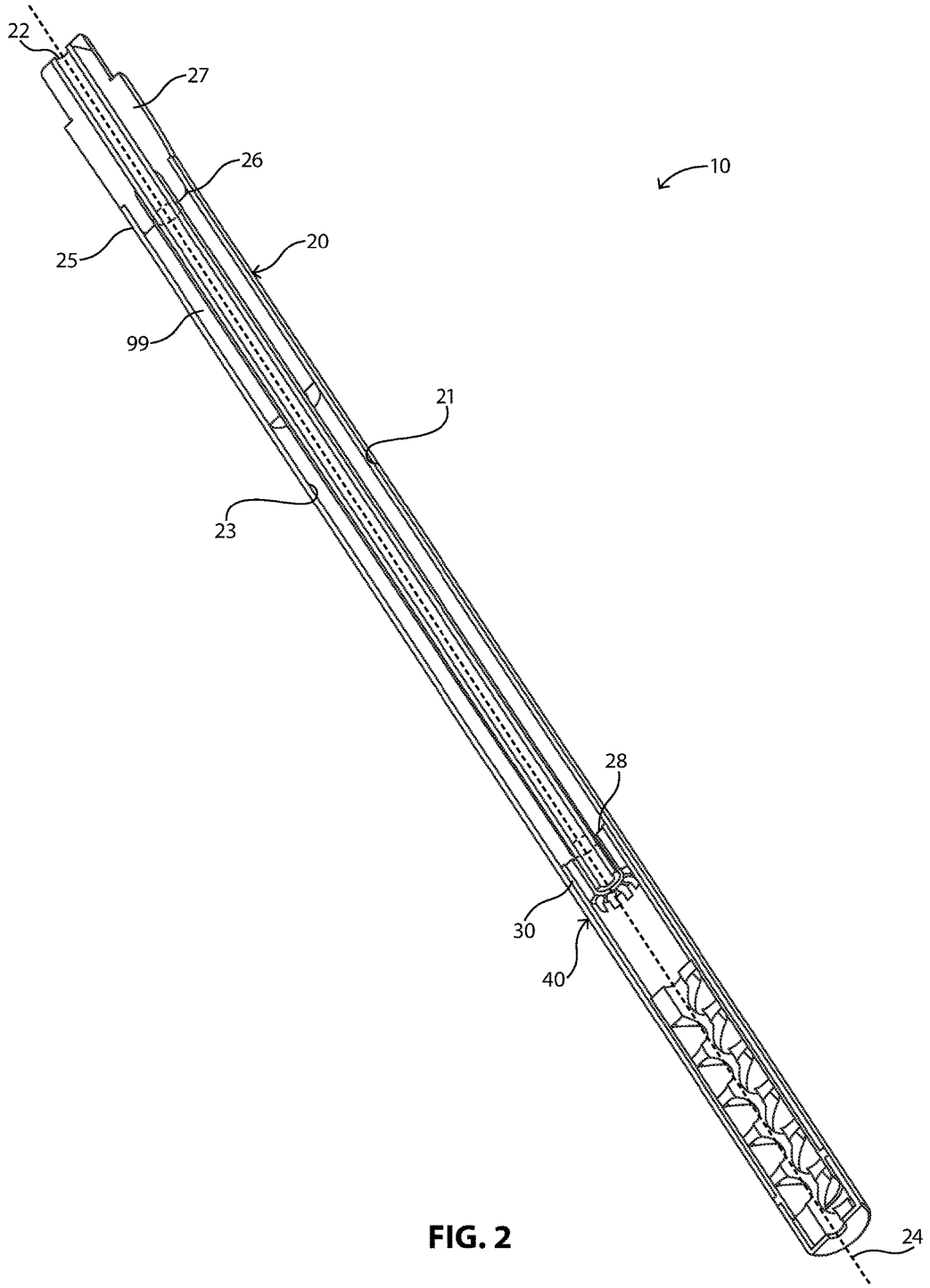
FIG. 2 illustrates a perspective cross section of a complete barrel assembly with an integrated sound suppression assembly according to one embodiment.
Figure 3:
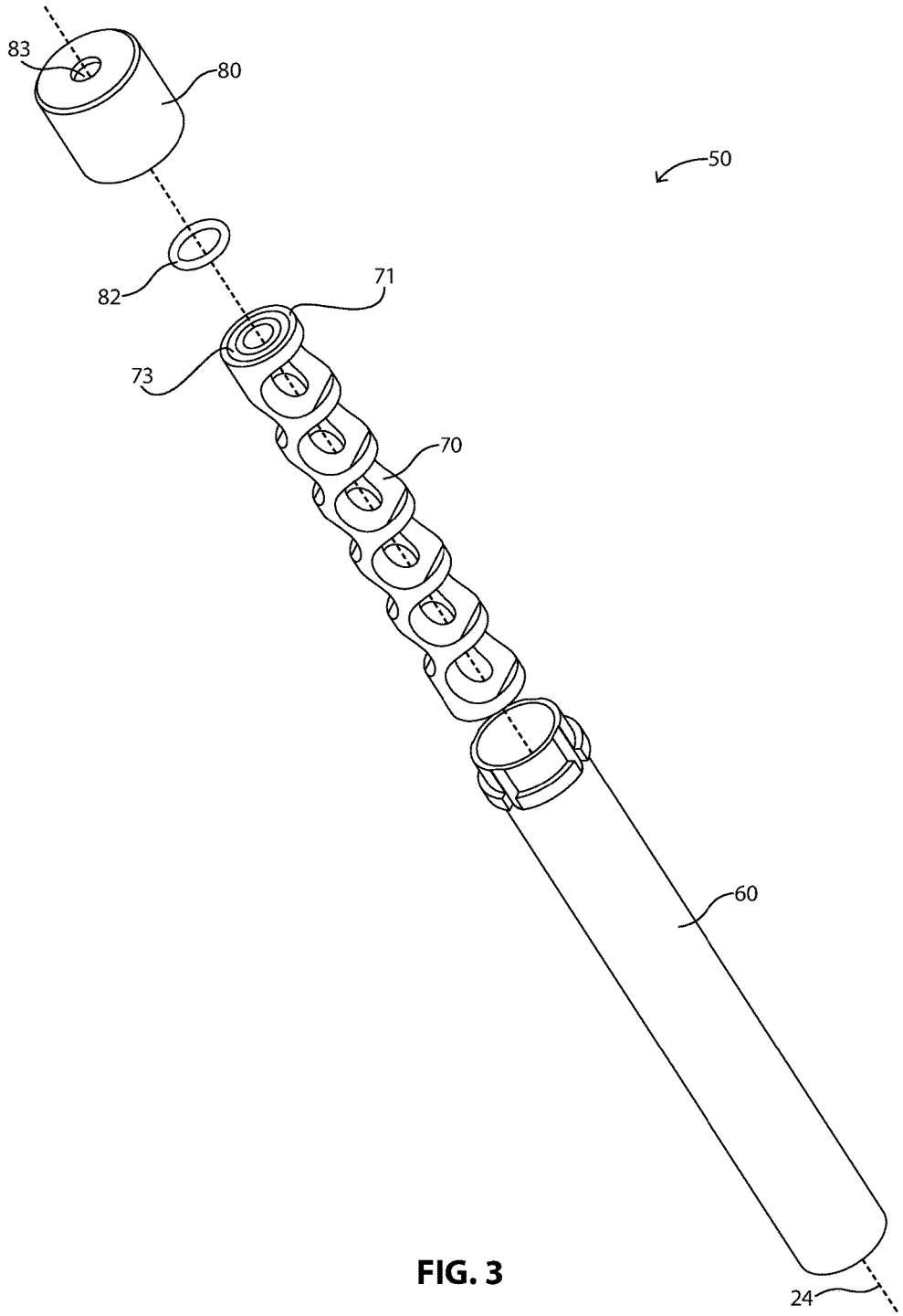
FIG. 3 illustrates a perspective exploded view of a sound suppression assembly according to one embodiment.
Figure 4:
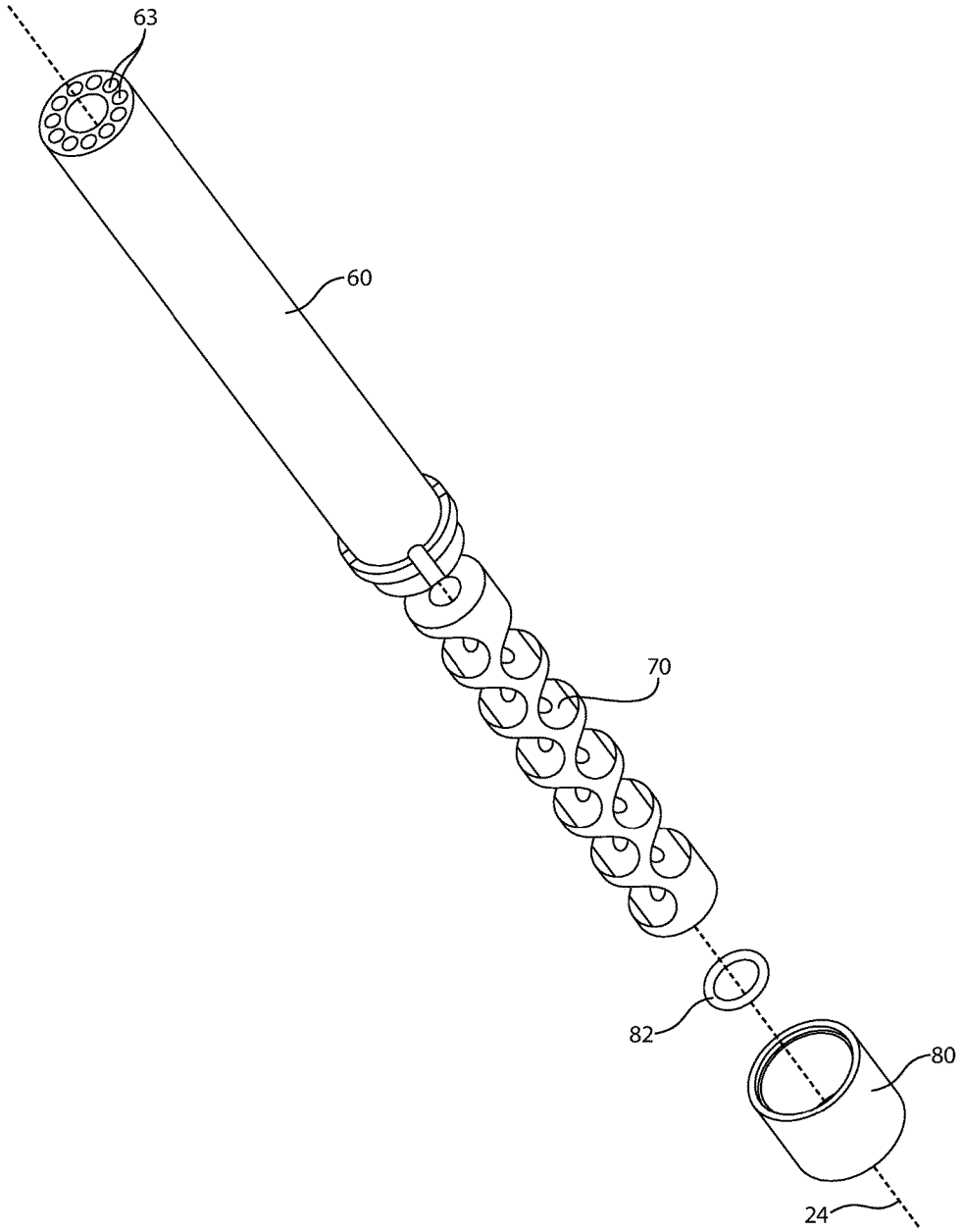
FIG. 4 illustrates an alternate perspective exploded view of the sound suppression assembly.
Figure 5A:
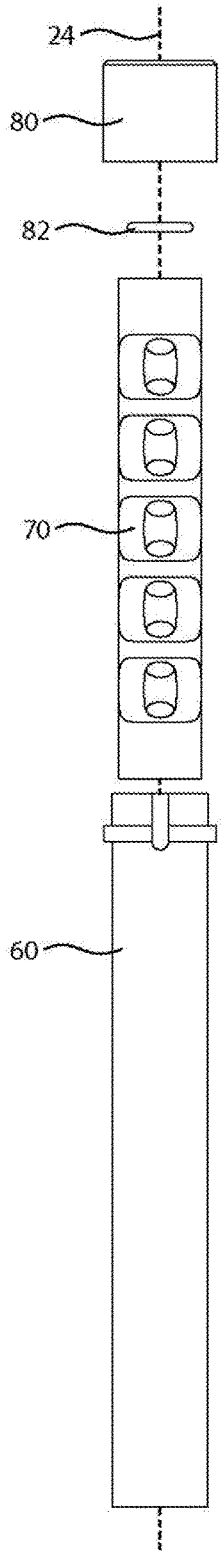
FIG. 5A illustrates a side view of a sound suppression assembly according to one embodiment.
Figure 5B:
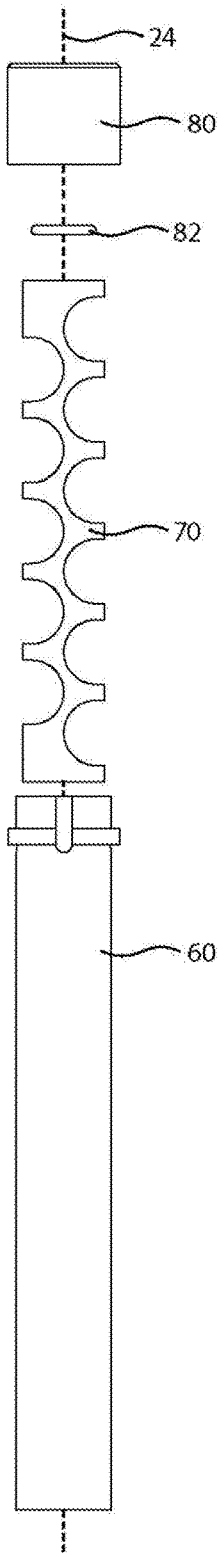
FIG. 5B illustrates an alternate side view of a sound suppression assembly according to one embodiment.
Figure 6:
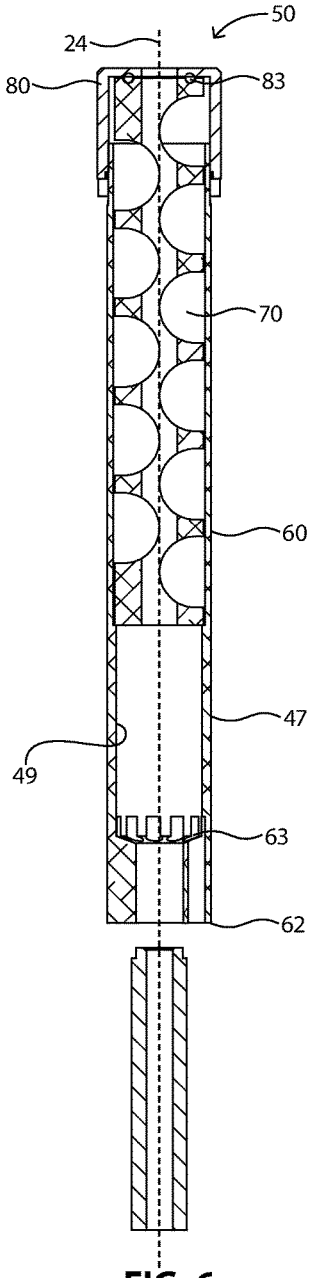
FIG. 6 illustrates a cross section of an assembled sound suppression assembly according to one embodiment.
Figure 7:
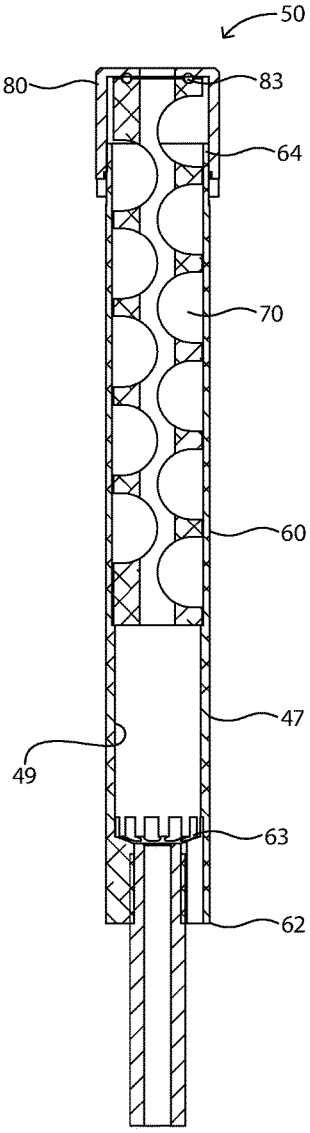
FIG. 7 illustrates a cross section of an assembled sound suppression assembly with an elongated bore joined to the sound suppression assembly according to one embodiment.
Figure 8:
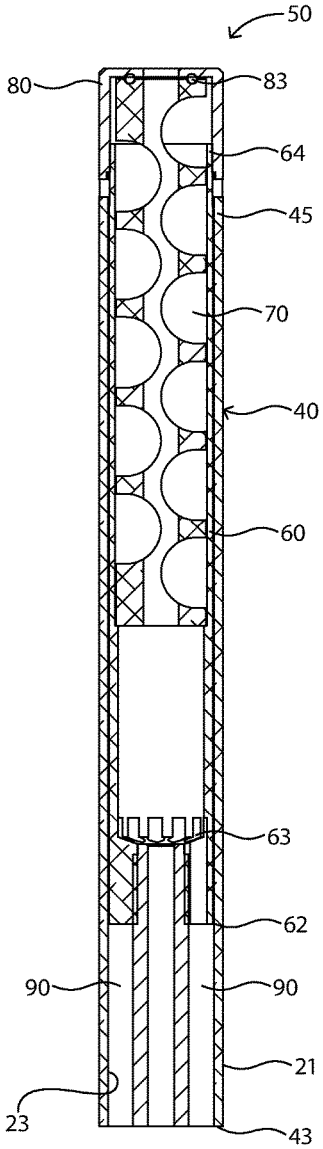
FIG. 8 illustrates a cross section of an assembled sound suppression assembly with an elongated bore and sleeve according to one embodiment.

Referring now to FIGS. 1-2, there is illustrated a firearm barrel assembly 10 according to one embodiment of the disclosure. The firearm barrel assembly 10 includes an elongated barrel 20, a sleeve 40, and a sound suppressor assembly 50. Advantageously, the firearm barrel assembly uses the barrel, together with the sleeve to improve the effectiveness of the sound suppressor assembly.

The elongated barrel 20 defines a barrel bore 22 having a bore axis 24. The elongated barrel 20 has a breech end 26 and a muzzle end 28.

The breech end can include a breech mounting facility 25 adapted to mate with a breech cap 27. In particular embodiments, the breech mounting facility 25 and the breech cap 27 can be threaded.

The muzzle end 28 can include a muzzle mounting facility 30 adapted to mate with a rear mounting facility of the suppressor tube element which is described in more detail below. In particular embodiments, the muzzle mounting facility 30 and the rear mounting facility of the suppressor tube can be complimentarily threaded for secure engagement with each other.

The elongated barrel 20 can have an outer surface 21 and an inner surface 23 defining a wall thickness therebetween. In certain embodiments, the elongated barrel 20 can have a particularly low wall thickness. For example, the elongated barrel can have a wall thickness of no greater than about 0.2 inches, no greater than about 0.15 inches, or even no greater than about 0.09 inches.

The barrel assembly can further include a heat sink 99 disposed adjacent the breach cap and disposed between the barrel and the sleeve. The heat sink can be adapted to provide a secure engagement during the assembly process as described in more detail in US Publication Number 20160209144, which is incorporated herein by reference for all useful purposes.

Referring now to FIGS. 3-8, the barrel assembly can include a sleeve and a sound suppression assembly. The sleeve 40 defines a sleeve bore and can have a rear end 43 adapted for connection to the firearm frame and a forward end 45 adapted for connection to the sound suppressor assembly. In particular embodiments, the sleeve can be disposed within the breech cap bore and the barrel bore. A projectile can travel within the sleeve bore and through the suppressor tube upon firing.

The sleeve can have an outer surface 47 and an inner surface 49 defining a wall thickness therebetween. In certain embodiments, the sleeve can have a particularly low wall thickness. For example, the sleeve can have a wall thickness of no greater than about 0.2 inches, no greater than about 0.15 inches, or even no greater than about 0.09 inches.

The gap between the sleeve and the elongated barrel can define an expansion chamber 90. The expansion chamber can be in communication with the suppressor tube such that shear and expanding gasses from a fired bullet can flow into the expansion chamber.

Disposed at least partially within the sleeve is a sound suppressor assembly 50. The sound suppressor assembly 50 can include a suppressor tube 60, a baffle 70 disposed within the suppressor tube 60, a gasket 83, and an end cap 80.

The suppressor tube 60 can have a rear end 62 and a forward end 64 opposite the rear end 62. The forward end 64 of the suppressor tube 60 is open and defines a suppressor tube bore.

The rear end 62 can include a rear mounting facility 66 that is adapted to mate with the muzzle mounting facility 30 of the barrel 20. In particular embodiments, the muzzle mounting facility 30 can be threaded. The muzzle mounting facility and the rear mounting facility of the suppressor tube can be adapted to remain connected to each other under tension.

The suppressor tube 60 can have an attachment facility on the forward end adapted for contacting the forward end of the sleeve. In particular embodiments, the forward attachment facility includes a rearward facing shoulder adapted to abut the forward end of the sleeve.

As illustrated, the suppressor tube element can be closely received within the sleeve.

The suppressor tube 60 can further include one or more vents 63 disposed toward the rear end 62. The one or more vents can be adapted to communicate with the expansion chamber between the sleeve and the barrel. In certain embodiments, the suppressor tube 60 can include a plurality of vents surrounding the suppressor tube bore. The suppressor tube bore is aligned with the bore axis 24. The vent tubes can be formed by machining the suppressor tube 60. The vent tubes can be in any desired configuration, including any desired number, arrangement, and profile of the vents depending on the needs of a particular application. In specific embodiments, suppressor tube can include a plurality of vents surrounding the suppressor tube bore. In particular embodiments, the plurality of vents can have a cylindrical profile.

The baffle 70 is disposed within the suppressor tube 60 and is configured to deflect and slow shear and expanding gases from a fired bullet. In certain embodiments, the baffle element 70 can include a plurality of individual baffles stacked together or in other embodiments the baffle element can be a monolithic piece with a plurality of machined baffles.

In certain embodiments, the baffle element 70 can include at least 5 baffles, at least 7 baffles, or even at least 9 baffles. In further embodiments, the baffle element 70 can include no greater than 17 baffles, no greater than 15 baffles, or even no greater than 13 baffles. In very particular embodiments, the baffle element 70 can include 11 baffles.

The baffle element 70 can have a width less than a width of the open forward end of the suppressor tube element such that the baffle element is received in the suppressor tube.

The barrel assembly can further include a forward end cap 80. The end cap defines a bullet aperture 83. The end cap can be adapted to be removeably connected to the forward of the tube element and operable to restrain the tube element.

A gasket 82 can be disposed between the forward end cap 80 and the forward end 71 of the baffle element 70. The forward end of the baffle element can include a recess 73 for receiving the gasket. The gasket element can be in the form of an O-ring and encircle the bullet aperture. The gasket can function to limit gas flow between the forward end cap and the baffle element.

The gasket 82 can further service to create a secure friction that retains the forward end cap and holds it in place without the cap loosening after extended firing.

Upon firing, the projectile is pushed through the muzzle end of the barrel and out of the firearm. The expanding gases behind the projectile are redirected and slowed by the series of baffles. The expanding gases are contained within the suppressor tube and pushed through the plurality of vents and into the expansion chamber between the outer surface of the sleeve and the inner surface of the barrel. By venting the expanding gas into the expansion chamber, the effectiveness of the sound suppressor assembly can be improved.

In particular embodiments, the muzzle end of the baffle stack can include an aperture. The aperture can be machined. The aperture can facilitate removal of the baffle stack for cleaning and servicing. For example, a complementary tool can be inserted into the aperture and torqued to facilitate removal.

In particular embodiments, the sound suppressor tube and/or the baffle assembly can be hard coated. For example, a suitable hardcoat can include polytetrafluorethylene (PTFE) infused anodized.

In certain embodiments, the barrel assembly with the integrated suppressor assembly can be in a modular configuration with the frame of the firearm. In other words, the barrel assembly can be removably attached to the frame of the firearm.

Another aspect of the present disclosure is directed to a method of assembling a barrel assembly with an integrated sound suppressor.

The sleeve is connected to the barrel tube. For example, the front end of the barrel can be and the rear end of the suppressor tube can be complementarily threaded and screwed together.

The breech cap and heated barrel assembly can be inserted into the barrel tube with a heat sink installed. For example, the barrel can be heated to a temperature of about 250 degrees Fahrenheit. The sonic tube can be inserted into the opposite end of the tube, threaded onto the muzzle of the barrel liner, and torqued while in the heated state.

When assembled with heat, as the inner barrel cools it can shrinks in length thus increasing the tension and strength of the entire assembly. This method of assembly can also prevent the barrel from gaining length and loosening as a result of the heat generated with repeated and continuous firing. Thus, assembling these components during a heated state can improve the integrity of the assembly under repeated firing.

Embodiments of the present disclosure represent a departure from the state of the art. For example, in particular embodiments, the shear and expanding gases from a fired bullet can be vented from the suppressor tube and directed into an expansion chamber. In this configuration, the barrel itself becomes an extension of the suppressor tube and provides additional volume to hold the expanding gases. Advantageously, by incorporating the barrel itself into the sound action of the sound suppression system, the effectiveness of a sound suppression system can be improved without increasing the overall length of the barrel.

Equivalent elements can be substituted for the ones set forth above such that they perform in substantially the same manner in substantially the same way for achieving substantially the same result. It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described is merely exemplary and an explanatory embodiment thereof.

We claim:

1. A firearm barrel assembly comprising:

an elongated barrel defining a bore having a bore axis;

the barrel having a breech end adapted for connection to a firearm frame;

the barrel having a muzzle end having a muzzle mounting facility;

a sleeve defining a sleeve bore and having a rear end adapted for connection to the breech end, the sleeve having a forward end opposite the rear end;

a suppressor tube element having a rear end having a rear mounting facility adapted to mate with the muzzle mounting facility of the barrel, the suppressor tube element having an open forward end and defining a tube chamber;

a baffle element separate from and removably received in the tube chamber and having a width less than a width of the open forward end of the tube element;

the baffle element having a cylindrical exterior and the suppressor tube element having a cylindrical interior configured to closely receive the baffle element exterior;

the suppressor tube element having a cylindrical exterior and the sleeve having a cylindrical interior configured to closely receive the suppressor tube element exterior;

the suppressor tube element having a forward end having a forward attachment facility adapted for contacting the forward end of the sleeve;

wherein the barrel has an intermediate portion spaced apart from the sleeve to define an expansion chamber aft of the suppressor tube element; and wherein the suppressor tube element defines a central aperture adapted to receive the barrel muzzle, and defines a vent aperture communicating between the tube chamber and the expansion chamber.

2. The firearm barrel assembly of claim 1, wherein the suppressor tube element is closely received within the sleeve.

3. The firearm barrel assembly of claim 1, including a plurality of vent apertures surrounding the central aperture.

4. The firearm barrel assembly of claim 1, including a forward end cap defining a bullet aperture and adapted to be removably connected to the forward end of the suppressor tube element to restrain the tube element.

5. The firearm barrel assembly of claim 4, including a gasket element compressibly received between the forward end cap and a forward end of the baffle element and encircling the bullet aperture to limit gas flow between the forward end cap and the baffle element.

6. The firearm barrel assembly of claim 1, wherein the forward attachment facility includes a rearward facing shoulder adapted to abut the forward end of the sleeve.

7. The firearm barrel assembly of claim 1, wherein the muzzle mounting facility and the rear mounting facility of the suppressor tube element are adapted to remain connected to each other under tension.

8. The firearm barrel assembly of claim 7, wherein the muzzle mounting facility and the rear mounting facility of the suppressor tube element are connected and torqued when the barrel is at a temperature of at least 200 degrees Fahrenheit.

9. The firearm barrel assembly of claim 1, wherein the barrel and suppressor tube element are under tension, and the sleeve is in compression.

10. A firearm barrel assembly comprising:

an elongated barrel defining a bore having a bore axis;

the barrel having a breech end adapted for connection to a firearm frame;

the barrel having a muzzle having a muzzle mounting facility;

a sleeve defining a sleeve bore and having a rear end adapted for connection to the firearm frame, the sleeve having a forward end;

a suppressor tube element having a rear end having a rear mounting facility adapted to mate with the muzzle mounting facility of the barrel, the suppressor tube element having an open forward end and defining a tube chamber;

a baffle element separate from and removably received in the tube chamber and having a width less than a width of the open forward end of the tube element;

the baffle element having a cylindrical exterior and the suppressor tube element having a cylindrical interior configured to closely receive the baffle element exterior;

the suppressor tube element having a cylindrical exterior and the sleeve having a cylindrical interior configured to closely receive the suppressor tube element exterior;

the suppressor tube element having an attachment facility adapted for contacting the forward end of the sleeve;

the rear end suppressor tube element defining a plurality of vent apertures providing gas communication to a chamber surrounding the barrel and encompassed by the sleeve;

wherein the barrel has an intermediate portion spaced apart from the sleeve to define an expansion chamber aft of the suppressor tube element; and wherein the suppressor tube element defines a central aperture adapted to receive the barrel muzzle, and the vent apertures surrounding the central aperture.

11. The firearm barrel assembly of claim 10, wherein the suppressor tube element is closely received within the sleeve.

12. The firearm barrel assembly of claim 10, including a forward end cap defining a bullet aperture and adapted to be removably connected to the forward end of the suppressor tube element to restrain the tube element.

13. The firearm barrel assembly of claim 12, including a gasket element compressibly received between the forward end cap and a forward end of the baffle element and encircling the bullet aperture to limit gas flow between the forward end cap and the baffle element.

14. The firearm barrel assembly of claim 10, wherein the attachment facility includes a rearward facing shoulder adapted to abut the forward end of the sleeve.

15. The firearm barrel assembly of claim 10, wherein the muzzle mounting facility and the rear mounting facility of the suppressor tube element are adapted to remain connected to each other under tension.

* * * * *